United States Patent [19]

Choi

[11] Patent Number: 4,796,893

[45] Date of Patent: Jan. 10, 1989

[54] PORTABLE GOLFBALL TEEING DEVICE

[76] Inventor: Young S. Choi, 3434 El Camino Real, Santa Clara, Calif. 95051

[21] Appl. No.: 57,215

[22] Filed: Aug. 3, 1987

[51] Int. Cl.[4] ..... A63B 57/00

[52] U.S. Cl. ..... 273/201; 124/51 R

[58] Field of Search ..... 273/201, 33, 26 D, 30, 273/202, 182 R, 191 R, 203; 124/48, 51 R, 45, 82, 85, 84, 50

[56] References Cited

U.S. PATENT DOCUMENTS

| | | | |
|---|---|---|---|
| 1,937,180 | 11/1928 | Young | 273/201 |
| 1,940,321 | 12/1933 | Pagett | 273/201 |
| 2,071,356 | 2/1937 | Pagett | 273/201 |
| 2,171,299 | 8/1939 | Beckett | 273/201 |
| 2,216,853 | 10/1940 | Middleton | 273/201 |
| 2,675,237 | 4/1954 | Willcox | 273/201 |
| 3,003,770 | 10/1961 | Jones | 273/201 |
| 3,127,177 | 3/1964 | Benkoe | 273/201 |
| 3,599,983 | 8/1971 | Melton | 273/201 |
| 3,756,606 | 9/1973 | Lund | 273/201 |
| 3,758,118 | 9/1973 | Willcox | 273/201 |
| 4,146,232 | 3/1979 | Stone | 273/201 |
| 4,177,996 | 12/1979 | Chang | 273/201 |
| 4,360,204 | 11/1982 | Karr | 273/201 |
| 4,441,717 | 4/1984 | Willcox | 273/201 |
| 4,575,092 | 3/1986 | Watson | 273/201 |

FOREIGN PATENT DOCUMENTS 574237 3/1933 Fed. Rep. of Germany ..... 273/201

*Primary Examiner*—Richard C. Pinkham
*Assistant Examiner*—T. Brown
*Attorney, Agent, or Firm*—William W. Burns

[57] ABSTRACT

The portable golfball teeing device consists of a portable case, the upper portion of which opens into a hopper to receive a bucket of golf balls. The apparatus within the case for separating and singularizing the golf balls consists of a platform at the bottom of the hopper having inclined surfaces leading to a funnel shaped opening in the platform, a rotatable cup located at the bottom of the funnel to receive the golf balls singly, and three blades which are suspended for movement through slits in the platofrm, the blades include an outer parallel pair which move in an arcuate path and a central blade which reciprocates in a vertical path. The blades are interconnected with the cup and move in response to movement of the cup. The cup is rotated by a linear gear, meshing with gear teeth on the cup, which is actuated by a foot pedal that is connected to the gear by a wire. In operation, pressure on the foot pedal rotates the cup to release a ball from the cup down a guide connected to the cup to a tee. As the cup moves the blades also move guiding balls into single file over the platform surface into the funnel and then, the cup.

6 Claims, 6 Drawing Sheets

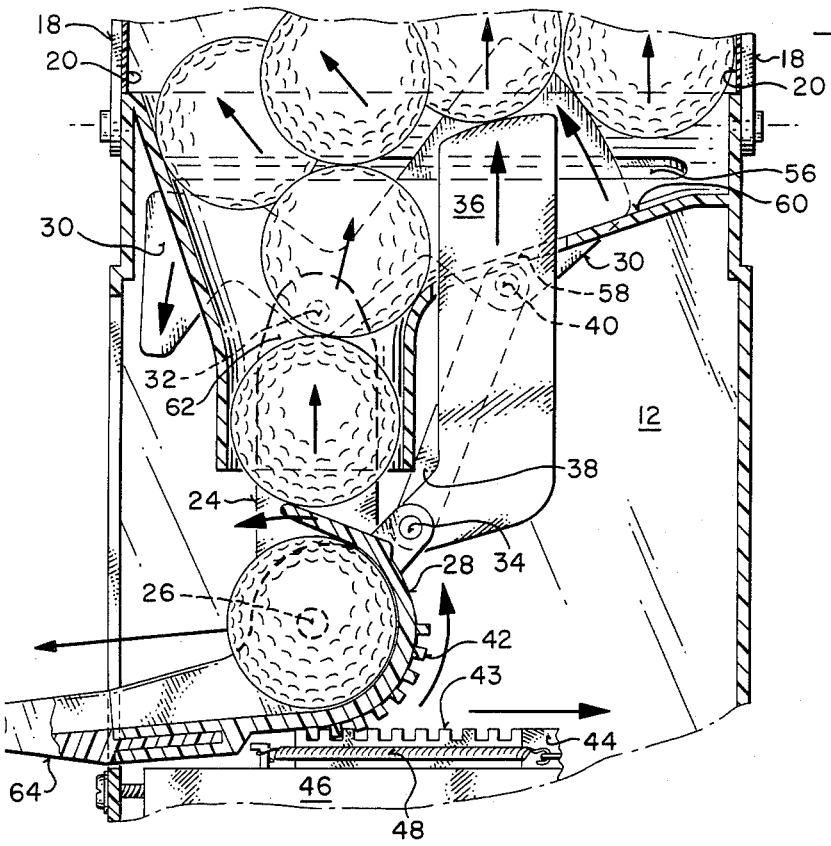
FIG 6
FIG 7
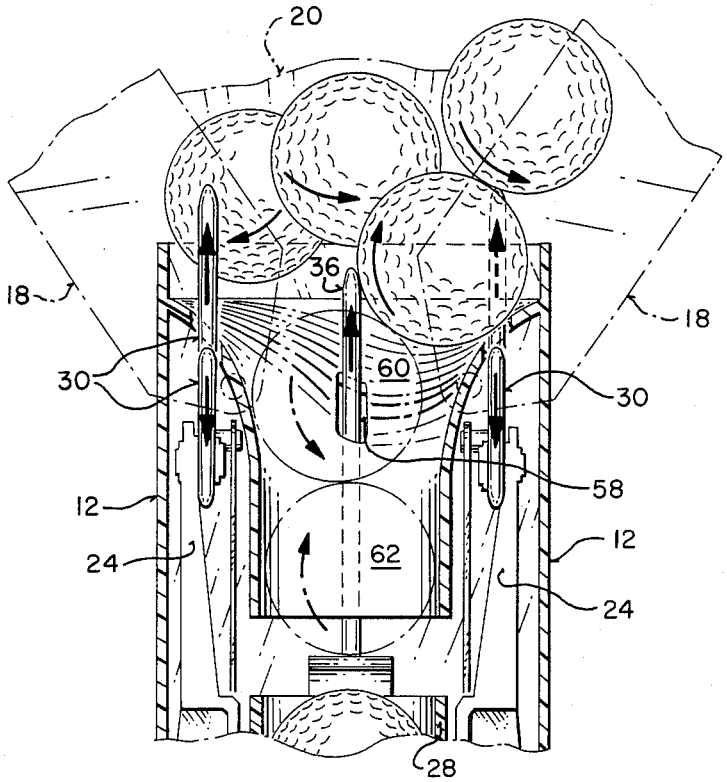

PORTABLE GOLFBALL TEEING DEVICE

BACKGROUND OF THE INVENTION

1. Field of the Invention

The present invention relates to devices for separating and singularizing spherical objects, and more particularly pertains to a new and improved portable device for teeing golf balls. The device folds into a small box so that it can be carried in a pocket of a golf bag.

2. Description of the Prior Art

The present invention is designed to be used by the golfer who wishes to improve or maintain his golf stroke. The invention would be used either at a driving range or an open field. The invention in its preferred embodiment is designed to contain more golf balls than prior devices and is also designed to be of lighter weight so that it is fully protable.

Attention is directed to the patent of Karr U.S. Pat. No. 4,360,204 which discloses a golf ball teeing device which consists of a helically wound container which feeds the golf balls through an electrically operated door. Attention is further directed to the patent of Jones U.S. Pat. No. 3,003,770 which discloses the use of a hopper.

SUMMARY OF THE INVENTION

The general purpose of the present invention, which will be described subsequently in greater detail, is to provide a new and improved golf ball teeing device which has all of the advantages of prior art golf ball teeing devices and none of the disadvantages. To obtain this, the present invention envisions a rectangular case having a pair of doors hingedly attached to the top. Flexible skirts are attached between the doors and form a hopper structure with the doors when the doors are opened. At the bottom of the hopper is a platform which consists of a series of inclined surfaces sloping downwardly to a funnel shaped opening. The surfaces also slope downward to a curved depression which forms a channel leading downward to the funnel to one side of center of the platform.

A pair of spaced blades are rotatably supported below the platform and move when actuated through slits near the edges of the platform. A central blade is supported below the platform for reciprocal movement through the platform.

A cup means is rotatably supported below the funnel, said cup means being interconnected for movement with said blades. A detachable ball guide is attached to the cup means.

A linear gear member which meshes with gear teeth on the dorsal surface of the cup means moves in a channel on the base of the case against the restraint of a set of biasing springs. The linear gear member moves in response to the pull of a wire that is detachably connected through the case to a foot pedal.

In operation a bucket of golf balls is placed into the hopper and the golfer steps on the pedal to tee up a ball. The liner gear member is pulled in response to the pull on the wire which in turn rotates the cup member one-quarter turn. A ball rolls down the ball guide and is deposited on the tee. Simultaneously the blades impart rotation to the balls in the hopper which frees the balls from jams and causes the balls to roll down the inclined surfaces of the platform to the channel which leads the balls single file into the funnel. As the golfer depresses the pedal and the cup means returns to its original position the next ball in line drops into the cup means and the device is once again ready to place a golf ball on the tee.

There has thus been outlined, rather broadly, the more important features of the present invention in order that the detailed description that follows may be better understood, and in order that the present contribution to art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures for carrying out the several purposes of the present invention. It is important, therefore, that the claims be regarded as including such equivalent constructions so far as they do not depart from the spirit and scope of the present invention.

It is therefore an object of the present invention to provide new and improved golf ball teeing devices which have all the advantages of prior art golf ball teeing devices and none of the disadvantages.

It is another object of the present invention to provide new and improved golf ball teeing devices which may be easily and efficiently manufactured and marketed.

It is a further object of the present invention to provide new and improved golf ball teeing devices which may be efficiently and reliably assembled in a rapid manner.

Even another object of the present invention is to provide new and improved golf ball teeing devices which are of a durable and rugged construction.

Still yet another object of the present invention is to provide a new and improved golf ball teeing device which is characterized by a portable and lightweight construction, whereby the same can be conveniently transported, stored, assembled and disassembled.

Even yet another object of the present invention is to provide a new and improved golf ball teeing device which is susceptible of a low cost of manufacture with regard to both materials and labor, and which accordingly is then susceptible of low prices of sale to the consuming public, thereby making such devices economically available to the buying public.

Even still another object of the present invention is to provide a new and improved golf ball teeing device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE DRAWINGS

.

FIG. 6 is a sectionalized side view disclosing the motion imparted to the golf balls as the central blade and rear portion of the outer blades are raised.

FIG. 7 is a sectionalized front view disclosing the rotation imparted to the golf balls as the central and outer blades are raised.

DESCRIPTION OF THE PREFERRED EMBODIMENT

Figure 1:
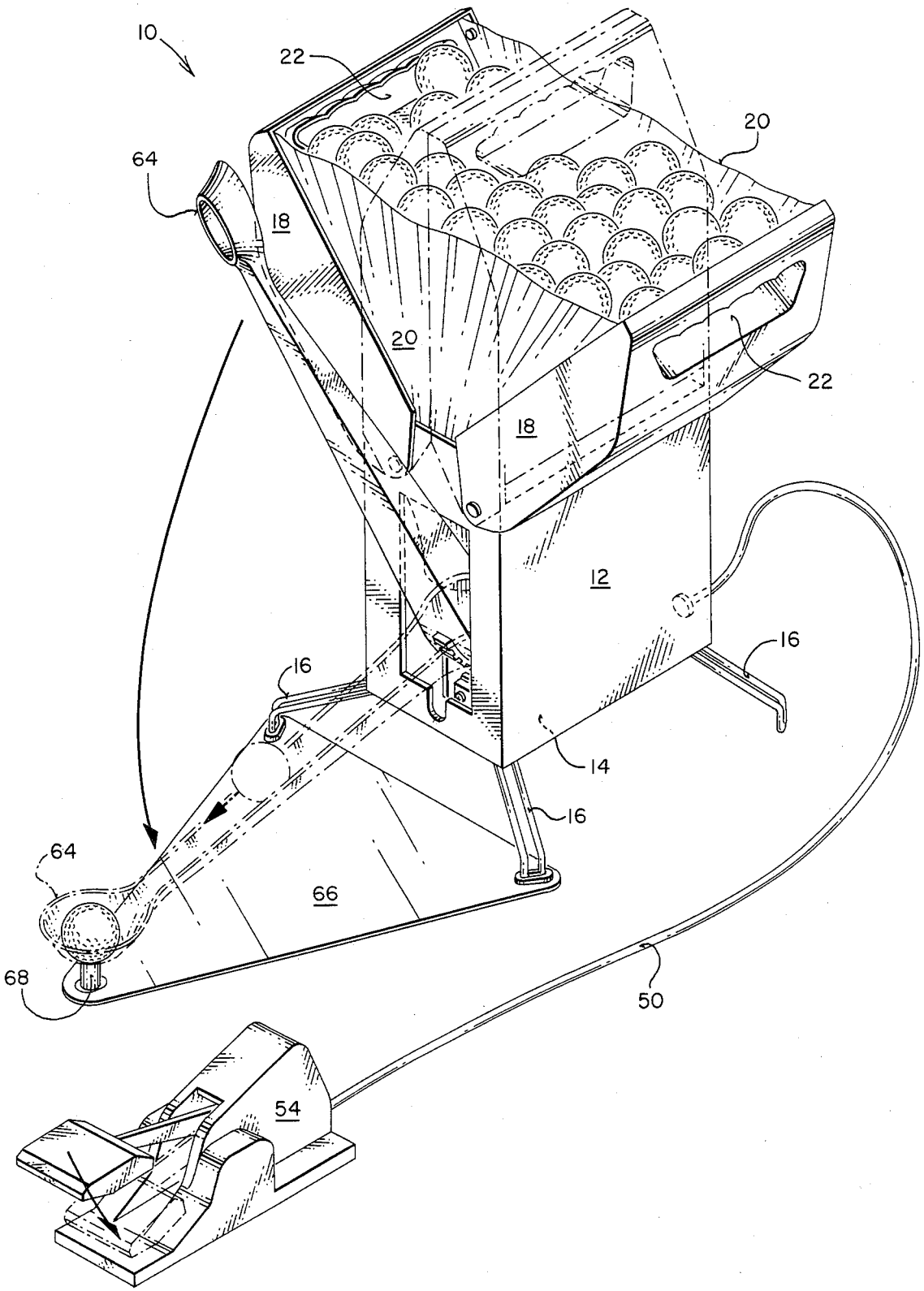
FIG. 1 is a perspective view of the present invention with the doors open to form a hopper and closed in phantom to form a handle for carrying.
Figure 2:
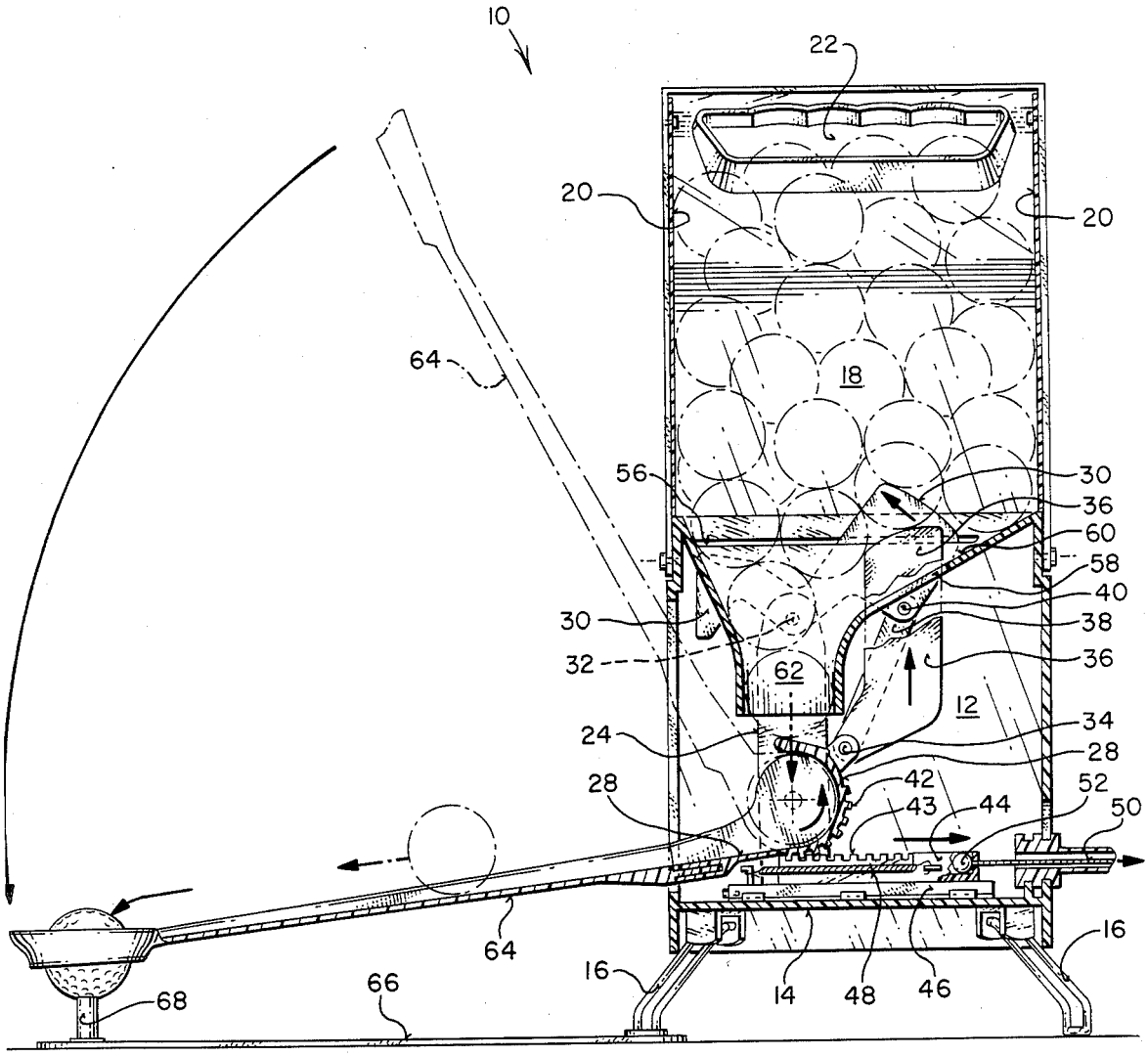
FIG. 2 is a sectionalized side view depicting the ball guide in its two extreme positions.
Figure 3:
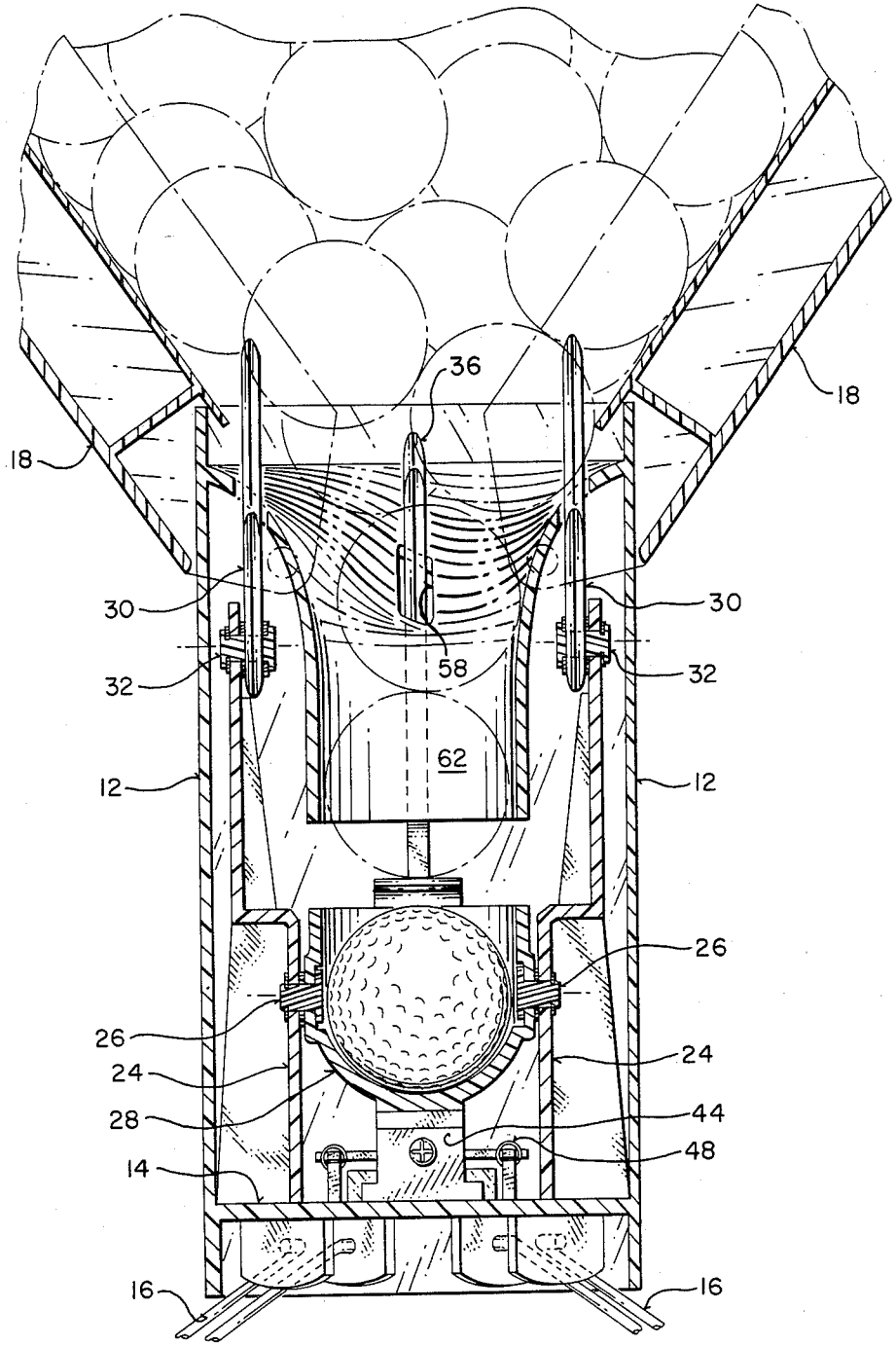
FIG. 3 is a sectionalized front view cut away through the funnel and cup and showing the contours of the platform.

In the preferred embodiment, the portable golf ball teeing device 10 shown in FIGS. 1 and 2 includes a rectangular boxlike case 12 including a base 14 to which four legs 16 are swingably attached. The base 14 can either be permanently attached or removable from the case 12.

Hingedly attached to the upper portion of the case 12 are doors 18 which are connected by the flexible membranes or skirts 20. The doors 18 and skirts 20 combine to form the hopper shown in FIG. 1 when the doors are fully open. When the doors are closed the skirts 20 fold inside the doors 18 and the openings 22 in the doors 18 combine to form a handle for carrying the portable unit.

The means or apparatus for separating or singulating golf balls or other spherical objects includes vertical support members 24 extending upwardly from the base 14. Rotatably supported on the support members 24 by shafts 26 is the cup member 28. At the upper end of the members 24, the parallel outer blades; 30 are rotatably attached on the shaft 32. Pivotally connected at the dorsal portion of the cup member 28 by the shaft 34 are the central blade 36 and the linking members 38. The linking members 38 are again pivotally connected at their upper end by shafts 40 to the outer blades 30.

The lower dorsal surface of the cup member 28 is studded with gear teeth 42 which engage the equally spaced gear teeth 43 of the linear gear member 44 which is constrained for linear travel upon the base 14 by linear gear support members 46.

The gear member 44 is further restrained by biasing members or springs 48 which retard the rearward movement of the member 44. The gear member 44 is connected to cable 50 by the ball 52 which resides in a slotted hole in the gear member 44 to allow for quick connection and disconnection of the cable. The cable 50 which is contained in a sheath is connected at its outer end to the foot pedal 54.

The blades 30 and 36 extend upwardly through the parallel slots 56 and the central slot 58 in the platform or sink 60. The slots 56 extend nearly the full length of the platform 60 to allow for the movement of the blades 30.

Figure 8:
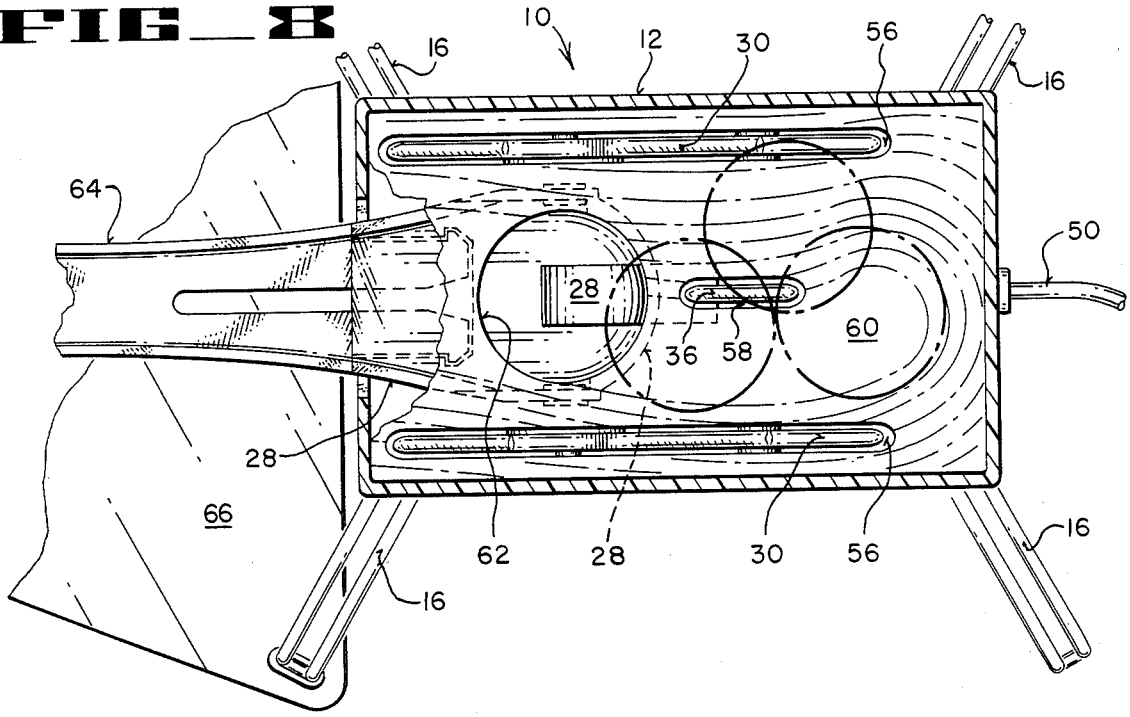
FIG. 8 is a sectionalized top view disclosing the contours of the platform, the location of the blades and the funnel.

The platform 60 is inclined from the posterior end of the platform to the funnel 62 which is located in the anterior portion of the platform 60 and directly above the cup member 28 such that the centerlines of the cup member 28 and the funnel 62 are colinear. The platform is further inclined from the left hand (facing the front portion of the case) slot 56, 30 to the centerline of the platform. The platform is recessed to one side of blade 36 to form a curved channel inclined downwardly to said funnel 62 (FIG. 8).

In operation a detachable ball guide 64 is attached by frictional coupling to an extended lip of the cup member 28. The other or outer end of the ball -guide 64 is cupped like a spoon with the center portion removed to describe a hole of a diameter that is slightly larger than the diameter of the golf ball. A triangular plate 66, to which is removably affixed a flexible tee 68, is secured to the legs 16 by slots in the plate 66.

In the preferred operation a golfer will first carry the device 10 to the desired location. He will then lower the legs 16 into position to support the case. The plate 66 will then be secured between the forward legs 16. The cable 50 will be attached to the gear member 44. And the ball guide 64 will be attached to the cup member 28.

The golfer is then ready to begin using the teeing device. The doors 18 are opened and a bucket of golf balls is poured into the hopper created by the doors 18 and skirts 20 when the doors are fully opened. As the balls are loaded into the hopper it is assumed with a full load of balls that a first ball will normally travel downwardly through the funnel 62 and rest in the cup member 28, which is in position to receive a ball before any other action is taken by the golfer.

To place the ball on the tee 68 the golfer presses the pedal 54 which action pulls the cable 50 which in turn pulls the linear gear member 44 against the springs 48 toward the rear of the case. As the gear member 44 is pulled rearward the gear teeth 43 of the member 44 engage the gear teeth 42 on the dorsal surface of the cup member 28 rotating the cup member 28 and the ball guide 64 through slightly more than 90°. As the cup member 28 and ball guide 64 are rotated the ball residing in the cup member 28 rolls gently down the ball guide 64, is stopped by the lip at the end of the ball guide 64 and rolls back to rest upon the tee 68. As the pedal 54 is depressed, the ball guide 64 returns to its original position and the golfer is ready to strike the ball on the tee 68.

Figure 4:
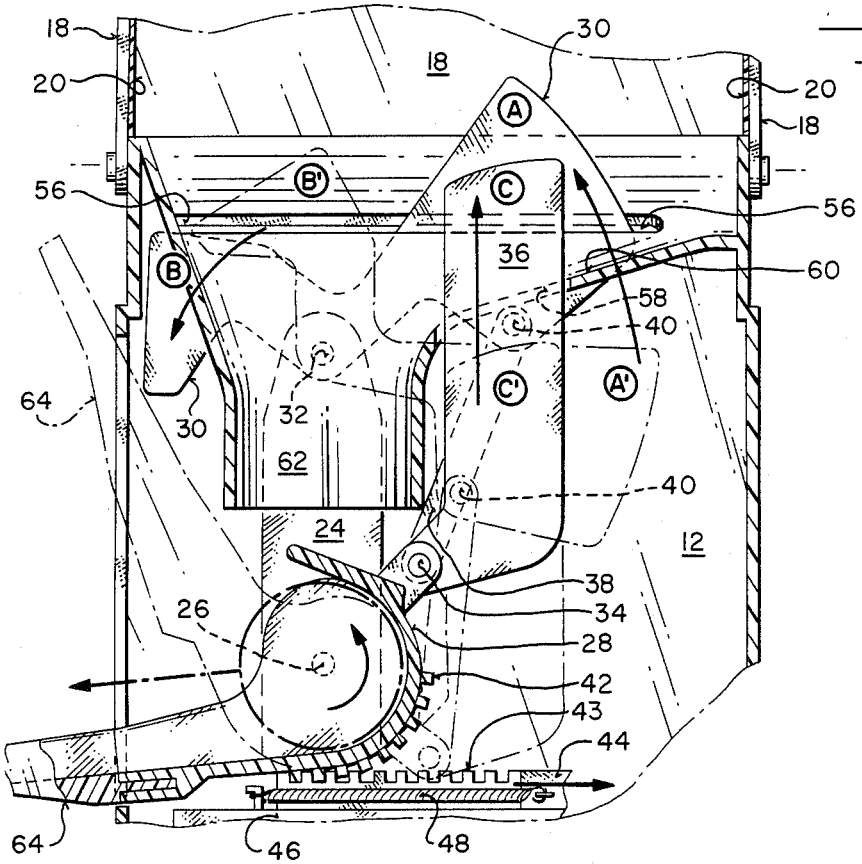
FIG. 4 is a sectionalized side view disclosing the relative positions of the cup and blades.
Figure 5:
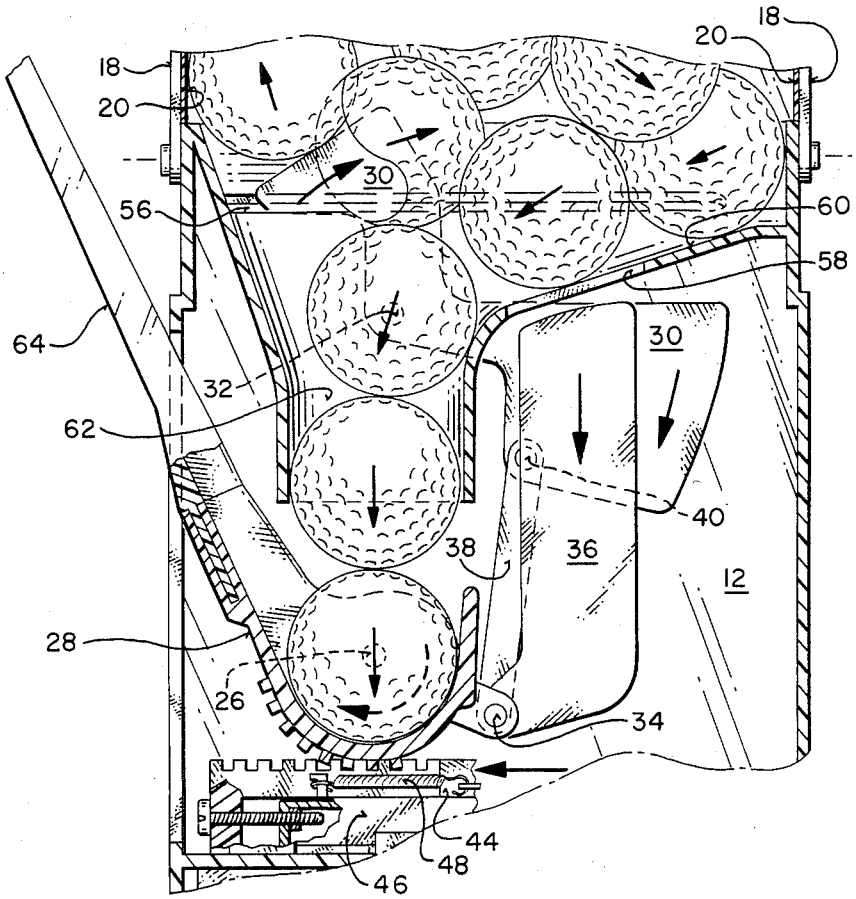
FIG. 5 is a sectionalized side view disclosing the direction of travel of the golf balls with the front portion of the outer blades fully raised.

As the pedal 54 is pressed as stated above the parallel blades 30 are rotated in an arc by the action of the linking members 38 in a counterclockwise direction such that the rear portion of the blades moves from an original position (A') (FIG. 4) to a raised position (A) (FIG. 4) and the front portion of the blades moves from a raised position (B') (FIG. 4) to a lowered position (B) (FIG. 4). Simultaneously the central blade 36 is pivoted directly upward in its slot from position (C') (FIG. 4) to position (C) (FIG. 4).

The movement of the blades and inclined surfaces of the platform 60 cooperate to rotate the golf balls toward the funnel 62. The outer blades 30 are positioned so that as the blades 30 are raised they strike the surface of the golf balls near the outer ends of the radii of the balls and thereby impart a rotation to the balls which tends to roll the balls toward the centerline of the platform 60. The unevenness of the surface of the platform 60 does not allow the golf balls to wedge together as no two balls are in the exact horizontal plane.

With the raised shoulder created to the left (facing the device from the front) of the central blade 36 a kidney shaped passageway or channel is formed to the right of the blade 36 for singulating the travel of the golf balls toward the funnel 62. The action of the blade 36 as it is raised strikes the outer surface of a ball and rotates the ball forward toward the channel and the funnel 62.

As the pedal 54 is depressed the pedal is moved to its first position by the tension of the biasing springs 48, the gear member 44 returns to its original position, the cup member 28 is rotated back to its original position, and the next ball drops into the cup. With the return of the cup member 28 to its original position the front portions of the blades 30 have moved to the raised position (B') (FIG. 4). In moving from position (B) to (B') the front portions of the blades 30 impart a rotation to balls toward the center and rear of the platform 60.

The combined effect of the blades 30 and 36, moving from positions (A') to (A), (C') to (C), and (B) to (B') is to rotate the golf balls inwardly from the sides and ends of the hopper structure, and to keep the balls, which have a tendency to jam together because of the dimpled surfaces, from jamming.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed as being new and desired to be protected by LETTERS PATENT of the United States is as follows:

1. A device for separating spherical objects comprising:

(a) an upstanding hopper means for holding a plurality of spherical objects;

(b) platform means having large and small openings, said openings being joined by an inclined wall to form a funnel shape, said large opening being attached to the lower end of said hopper and said small opening extending downward therefrom, said wall having a plurality of elongated slots therein to move only in single file through said small opening;

(c) blade means, including a pair of parallel blades that travel in an arcuate path through a corresponding pair of elongated slots in said wall and a third blade that reciprocates vertically through a third slot in said wall said blade means cooperating to rotate said spherical objects downward in single file toward said small opening; and (d) rotatable cup means below said opening to singly receive said object through said opening and to deliver said object in response to actuation; and (e) pedal means interconnected to said cup means whereby pressing of said pedal means simultaneously actuates or rotates said cup means to deliver a spherical object while simultaneously causing said blade means to rotate spherical objects toward the opening.

2. A golf ball teeing device comprising:

(a) case means, including a hollow upstanding base and door means said door means being a pair of opposed members hingedly attached to the top of said case flexible skirt means connected between said pair of member to form a hopper to receive golf balls when said member are in an opened position;

(b) platform means at upper end of said base, said platform means being a funnel shaped member, the large end of said funnel shaped member being attached to the lower end of said hopper and the small end of said funnel shaped member extending downward a predetermined distance into said base to allow balls to move in single file into said; base, said funnel shaped member having a plurality of slots therein for receiving a blade means, (c) blade means manually attached in said base for vertical movement through said funnel member, means for actuating said blade means said blade means cooperating with said funnel member when actuated to rotate golf balls singly through the small end of said funnel member (d) cup means to receive golf balls singly from said pivotally attached to said base funnel member and to deliver golf balls singly to a tee; and (e) pedal means to actuate the blade means and the pivotally attached cup means to deliver golf balls single to the tee.

3. The device of claim 2 wherein said blade means comprises two spaced blades which move in an arcuate path and a central blade which reciprocates in a vertical path.

4. The device of claim 3 wherein said cup means includes a ball guide which guides each golf ball to the tee as the cup means is rotated through one quarter turn.

5. The device of claim 4 wherein the inclined inner surface of said funnel member maintains each golf ball in said hopper in a separate horizontal plane so that the balls, which have dimpled surfaces, cannot wedge or jam together.

6. The device of claim 5 wherein said pedal means includes a pedal that is connected by a wire to a spring biased linear gear which meshes with gear teeth on lower surface of the guide and thus to said cup means whereby cup means is rotated to deliver a ball to the tee.

* * * * *